US005091731A

United States Patent [19]

Rees

[11] Patent Number: 5,091,731

[45] Date of Patent: Feb. 25, 1992

[54] ELECTROMAGNETIC RADIATION SENSORS

[75] Inventor: Huw D. Rees, Malvern, England

[73] Assignee: The Secretary of State for Defence in Her Britannic Majesty's Government of the United Kingdom of Great Britain and Northern Ireland of Whitehall, London, United Kingdom

[21] Appl. No.: 160,902

[22] Filed: Jan. 5, 1988

Related U.S. Application Data

[63] Continuation of Ser. No. 357,080, Mar. 9, 1982.

[30] Foreign Application Priority Data

Mar. 11, 1981 [GB] United Kingdom ..... 8107622
Jul. 7, 1981 [GB] United Kingdom ..... 8121002

[51] Int. Cl.[5] ..... H01Q 15/02
[52] U.S. Cl. ..... 343/700
[58] Field of Search ..... 343/762, 779, 780, 783, 343/785, 700, 911 R, 753, 908, 909; 455/326, 327, 330, 333, 323, 325, 313; 333/128, 247, 250; 340/572; 342/351, 42, 44

[56] References Cited

U.S. PATENT DOCUMENTS 3,296,536 1/1967 Copeland et al. .
3,373,425 3/1968 Barischoff .
3,718,935 2/1973 Ranghelli et al. .
3,781,896 12/1973 Toulis ..... 343/911 R
4,122,449 10/1978 Endo ..... 455/333
4,123,754 10/1978 Armstrong .
4,125,810 11/1978 Pavio ..... 455/327
4,331,957 5/1982 Enander et al. .
4,387,378 6/1983 Henderson ..... 342/374

FOREIGN PATENT DOCUMENTS 2738549 3/1979 Fed. Rep. of Germany .

OTHER PUBLICATIONS

Copeland et al., Antennas Have Built-In Circuits, In: Electronic Industries, May 1963, pp. 115-120.
Copeland, J. R. et al.; Design of Antennaverters and Antennafiers. In: Electronics, Oct. 6, 1961, pp. 68-71.
Rutledge, D. B. et al., Antennas and Waveguides for Far-Infrared Integrated Circuits, In: IEEE Journal of Quantum Electronics, vol. 1, QE-16, No. 5, May 1980.
Mizuno, K. et al., Design of Printed Resonant Antennas for Monolithic-Diode Detectors, In: IEEE Transactions on Microwave Theory and Techniques, vol. MTT-25, No. 6, Jun. 1977, pp. 470-472.
Murphy, R. A. et al., Submillimeter Hetrodyne Detection with Planar CaAs Schottky-Barrier Diodes, In: IEEE Transactions on Microwave Theory and Techniques, vol. MTT-25, No. 6, Jun. 1977, pp. 494-495.
Hwang, T. L. et al., Planar Sandwich Antennas for Submillimeter Applications. In: Appl. Phys. Lett. 34(1), Jan. 1, 1977, pp. 9-11.
Clifton et al., Conference on IR and MM Waves, Dec. 1979; pp. 84-86.

*Primary Examiner*—Theodore M. Blum
*Attorney, Agent, or Firm*—Cushman, Darby & Cushman

[57] ABSTRACT

A radiation sensor for centimeter, millimeter or sub-millimeter waveband receiption, comprising a metal antenna located close to a supporting dielectric body of intermediate to high dielectric constant value and having a mixer located in between and connected to the limbs of the antenna. The supporting body may itself be of semiconductor material, or if of insulating dielectric material, semiconductor material may be incorporated adjacent the antenna; and the mixer components, diodes, integrated in the semiconductor material. Antennae, as above, may be arranged in close-packed array, and the supporting body configured as, or as part of, a lens.

12 Claims, 8 Drawing Sheets

ELECTROMAGNETIC RADIATION SENSORS

This is a continuation, of application Ser. No. 357,080, filed Mar. 9, 1982.

TECHNICAL FIELD

The present invention concerns radiation sensors—particularly millimeter waveband sensors responsive to radiation having a frequency in the range 30 to 300 GHz as also sensors responsive to radiation of centimeter (3 to 30 GHz) or sub-millimeter wavelength (300 GHz→). Combining both reasonable angular resolution and compact size millimeter waveband sensors compare favourably with radars responsive to lower microwave frequencies, for although they have a limited operating range, they exhibit an inherent resistance to long distance interference and perform satisfactorily under most weather conditions. They are of interest for passive radiometer and radar applications for surveillance, mapping and imaging, and are also of interest for short-range communications links.

BACKGROUND ART

A typical millimeter waveband sensor includes a micro-circuit mixer connected via a waveguide to an aerial collecting dish. This micro-circuit usually consists of a dielectric support plate having patterned conductors and bonded semiconductor mixer components—e.g. diodes—on one surface and may also be metallised over all or part of the other surface. The positioning of these components is extremely critical. The micro-circuit is usually mounted in the waveguide cavity or else is connected to the waveguide by a specially designed transition. The positioning of this circuit relative to the waveguide is also critical. The accurate positioning of the compoments and the positioning of the micro-circuit are demanding mechanical tasks and are largely responsible for the relatively high production cost of these conventional sensors. These sensors have been considered difficult to set up, fragile and expensive.

DISCLOSURE OF THE INVENTION

The present invention provides a mechanically rugged and compact sensor of an alternative construction. The mixing component or compoments of the sensor can be integrated and embodied in its structure therefore avoiding mechanical bonding; the positional tolerance is well within the tolerance achieved by conventional integrated circuit technology. The radiation acquisition does not of necessity require a waveguide cavity, so mounting problems of the same nature do not arise.

In accordance with the invention there is provided an electro-magnetic radiation sensor comprising:

- a high resistivity support body of dielectric material, the dielectric constant of this material being of intermediate to high value;
- a metal antenna arranged over the upper surface of the support body in such close proximity thereto, that the resonance of the antenna is dependant upon the dielectric properties of the support body;
- a mixer including at least one mixer diode located between opposite limbs of the antenna for providing a radiation path therebetween; and,
- at least one low frequency output port, each one connected across at least one such mixer diode, low frequency signal developed in response to a mixing of higher frequency input radiation.

The support body may be of dielectric material of intermediate dielectric value—a value typical for semiconductor materials (e.g. $\epsilon \simeq 9$ to 15), and indeed, may be of semiconductor material—for example (Si) or, gallium arsenide (GaAs). Alternatively, to facilitate the design of co-operative low frequency integrated circuitry, the support body may be a substrate of insulating dielectric material, or high resistivity semiconductor material, having one or more thin layers of relatively low resistivity semiconductor material on its surface. Each layer may be an epitaxial layer grown on the substrate surface.

Whilst the antenna may be in direct contact with the surface of the support body, being formed directly on semiconductor material, it is preferable that it is spaced from this material by a layer of passive dielectric material, in order to protect the material's surface and to avoid the formation of undesirable compounds between the metallic antenna and the semiconductor material of the support body.

The support body may be of dielectric material of high dielectric value—for example of barium titanate ($\epsilon=39$) or titanium dioxide ($\epsilon=80$). This choice of material is particularly favoured for longer wavelength (lower frequency) applications, as it permits scaling down of antenna dimensions. It is preferable, in this case, to include semiconductor material for integration of the diode or diodes and any other circuit components. It may be included either as a substrate on the reverse side of the antenna, or as a thin layer (i.e. thin compared with dipole length) between the antenna and the support body.

The antenna may have two limbs only, arranged in the form of a dipole. These limbs may be of narrow strip, wide strip or fanned out shape according to application. For this arrangement of the antenna, the sensor may comprise a single ended mixer formed of at least one diode, the output port being provided by a transmission line formed of two parallel strips, each strip being co-extensive with, and extending orthogonal to a corresponding one of the antenna limbs.

The antenna may have four limbs, each pair of opposite limbs being arranged in the form of a dipole, with adjacent limbs orthogonal to each other. For this latter arrangement of the antenna, the sensor may comprise a balanced mixer formed of a diode ring, the diodes being arranged head to tail around the ring, each diode being connected across a pair of adjacent limbs, the output port being provided by a pair of conductive channels embodied in the substrate, each connected to a corresponding one of two adjacent limbs. In preference, one or more of the antenna limbs may be split along its length, the diodes being arranged around the ring so that the output port is provided by one of these split antenna limbs.

Alternatively, for this latter arrangement of the antenna, the sensor may comprise a coherent mixer formed of a diode ring including in between pairs of diodes a transmission line, this transmission line extending in between the upper and lower limbs of the antenna and forming part of the dipole formed thereby, and having an electrical length of one-quarter wavelength at the signal frequency.

In a preferred construction of this sensor, the side limbs are each split along their length into upper and lower branches, each side limb providing an output port, one for the in-phase, and the other for the quadrature, output signals from the mixer.

It is convenient to combine the sensor with a low frequency amplifier circuit embodied and integrated in the substrate. It is an advantage that where the output port is provided as a transmission line or as a split antenna limb, all or part of this circuit can be embodied in the underlying region of the semiconductor, where the high frequency electric field parallel to the semiconductor surface is weak. Since this combined unit is compact and self-contained, it may be arranged in array with other sensors, each sensor being formed in a common substrate. Where many sensors are combined in this way, multiplex circuitry can be included with each amplifier circuit to facilitate signal processing and access.

Input radiation may be collected by means of a dielectric lens. In this case the sensor, or array of sensors, may be arranged with the lower surface of the support body integral with or bonded to the rear body of the lens, so that radiation can be efficiently coupled to the antenna or antennae.

BRIEF DESCRIPTION OF THE DRAWINGS

Examples of the invention will now be described with reference to the accompanying drawings of which.

DESCRIPTION OF EMBODIMENTS OF THE INVENTION

Figure 1:
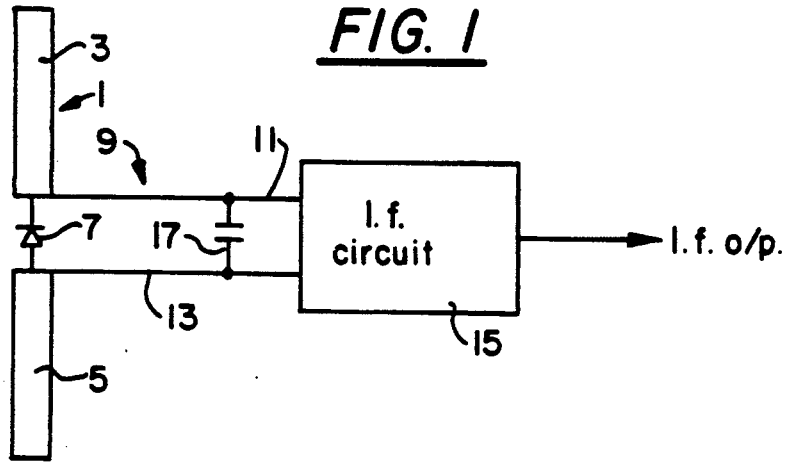
FIG. 1 is an illustrative diagram of a millimeter waveband sensor having an output circuit connected across its l.f. output port.

The sensor shown in FIG. 1 comprises a narrow strip metal dipole antenna 1 having an upper limb 3 and a lower limb 5. This metal antenna 1 lies on the upper surface of a high resistivity supporting substrate and the two limbs 3, 5 of this antenna 1 are spaced apart at the dipole centre and interconnected by a single-ended mixer, a Schottky-barrier mixer diode, 7, embodied in between the limbs 3, 5 in the upper surface of the substrate. Connected across this diode 7 and extending from the two antenna limbs 3, 5 in a direction orthogonal to the dipole axis of the antenna is a transmission line 9 formed of two parallel extension branches 11, 13 also of narrow metal strip.

This transmission line 9 provides a means to relay low frequency response signal, i.e. signal developed across the diode 7 when radiation of appropriate frequency is received by the antenna 1 and mixed by the diode 7. This transmission line 9 is connected, at points remote from the antenna 1, across the input of a low frequency (l.f.) circuit 15, adjacent the sensor, a circuit integrated and embodied in the upper surface of the substrate.

The length and width of the antenna 1 are both chosen so that the antenna 1 is suitable for receiving radiation having a frequency lying in the 25 to 500 GHz range. The antenna 1 shown is chosen to have a length equal to one-half wavelength corresponding radiation of 100 GHz frequency. This length is governed by the antenna geometry, the dielectric constant $\epsilon$ of the supporting substrate, and the dielectric constant $\epsilon'$ of the ambient medium, air ($\epsilon'=1$). Detailed calculation shows that the resonant length of a supported antenna is inversely proportional to a scaling factor $\bar{n}$, and that the antenna admittance is directly proportional to this scaling factor $\bar{n}$, the factor $\bar{n}$ being to a good approximation independent of the antenna geometry and related to the media constants by the formula:

$$\bar{n} = \sqrt{(\epsilon + 1)/2}$$

i.e. the square root of the average of the dielectric constants of the two media, one of which is air in the present embodiment. In the example, the substrate is of silicon semiconductor material ($\epsilon \simeq 11.7$). The scaling factor $\bar{n}$ thus has a value 2.5 approximately and the length of the antenna 1, one-half wavelength ($\lambda/2$) at a resonant frequency of 100 GHz, is calculated to be 600 $\mu$m approximately. For an antenna width of 10% of the antenna length, the resonance is calculated to extend from about 0.75 to 1.1 times the half wavelength frequency, so an antenna of length 600 $\mu$m and width 60 $\mu$m is suitable for frequencies from 75 to 110 GHz.

The transmission line 9 is designed to have an electrical length of approximately one-quarter wavelength ($\lambda/4$) at the resonant frequency.

This length, approximately 300 $\mu$m, it is noted, may differ marginally from the value of one-quarter wavelength calculated for the antenna, for here in the propagation mode the high frequency current flow in the two branches 11 and 13 of the transmission line 9 is that of two equal magnitude components flowing in opposite directions. A shunt capacitance 17, across the transmission line 9, is included to ensure that a reactive impedance of high value, effectively open circuit, is presented across the diode 7. The transmission line 9 thus provides an output port effectively isolated from high frequency, to relay low frequency currents developed across the diode 7 to the l.f. circuit 15. The width of the transmission line 9 is chosen to be small $<50$ $\mu$m and it is arranged orthogonal to the antenna 1 to ensure that the line 9 interferes to minimal degree with the action of the antenna 1.

Alternatively, the transmission line 9 may be designed as a periodic line having a suitable stop band.

The l.f. circuit 15 includes an integrated pre-amplifier stage with grounded emitter or grounded base transistor input and may also include more advanced circuit components e.g. time multiplex components.

Figure 2:
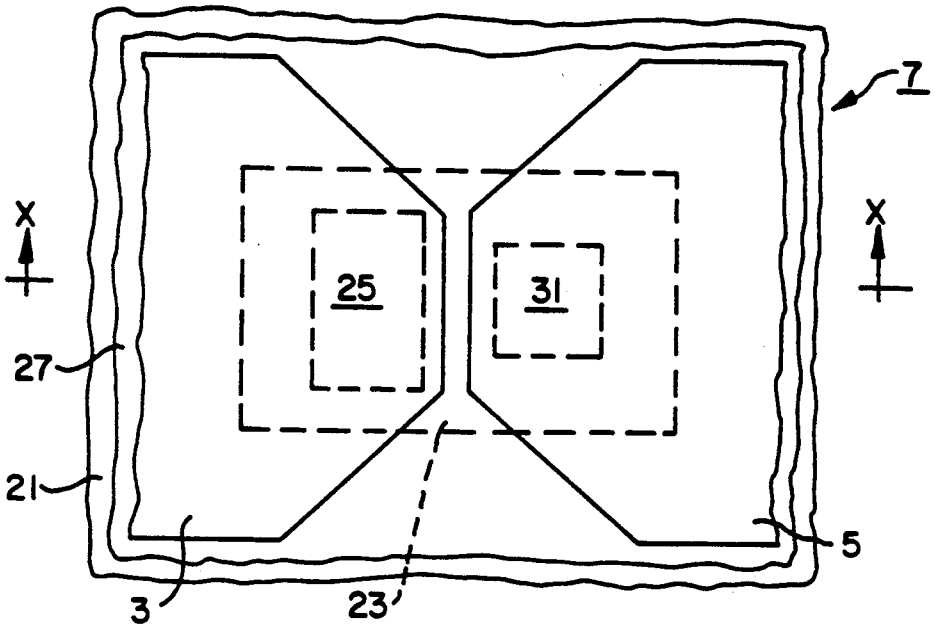
FIG. 2 is an illustrative plan detail of the mixer of the sensor shown in FIG. 1 above.
Figure 3:
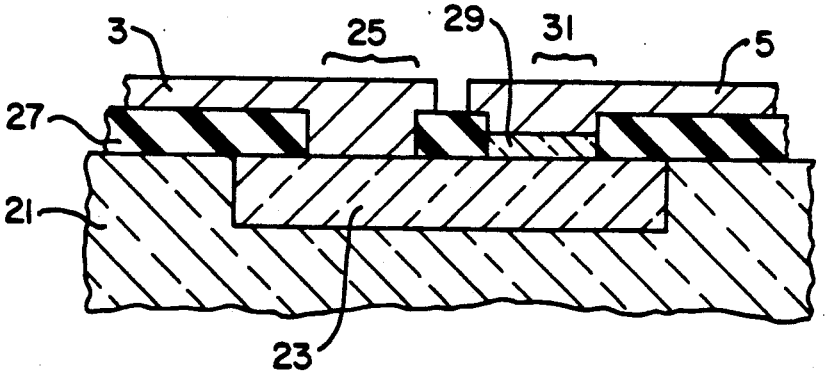
FIG. 3 is a cross-section drawing of this mixer taken through lines X—X of FIG. 2 above.

The construction of the mixer part of the sensor 1 is shown in detail om FIGS. 2 and 3 of the drawings. The mixer consists of a Schottky diode 7 embodied in the silicon material of the substrate 21. This silicon material is of relatively high resistivity, having in this example a value in excess of 100 ohm cm. This is chosen to minimise the attenuation of input radiation travelling through from the underside of the substrate.

It is noted that an antenna supported on a substrate ($\epsilon > 1$) couples predominantly to radiation in the medium of higher dielectric constant, i.e. into the substrate.

The attenuation loss is given approximately by the ratio ($Z/\rho_s$), where Z is the characteristic impedance for radiation propagating through the substrate, $\rho_s$ the sheet resistivity. For the silicon substrate ($Z \simeq 100\ \Omega$) which is here of nominal thickness 400 μm, a resistivity of 100 ohm cm corresponds to an attenuation loss of approximately 5%, an acceptable value. The antenna impedance and radiation polar diagram are also sensitive to the substrate resistivity, but for the antenna described above the effect is small for a substrate resistivity of 100 Ω centimetre or more.

The substrate 21 includes a region 23 of excess doped $n^+$-silicon formed by diffusion or other technique—e.g. by implantation. An ohmic contact is made between the metal of one of the antenna limbs 3 and this $n^+$ region 23 through a window 25 in an insulating layer 27 of silicon oxide dielectric material interposed between the limbs 3 and 5 and the substrate 21. An n-type silicon region 29 in another window 31 in the insulating layer 27 joins the $n^+$ region 23 and the other antenna limb 5 forms a Schottky barrier contact on the upper side of the n-type region 29. The diode dimensions are approximately 10 μm square overall, most of the diode area being taken up by the ohmic metal semiconductor contact 3/23. The diameter of the barrier contact is chosen so that the diode impedance is matched to the resonant impedance ($\simeq 25\ \Omega$) of the antenna 1. The diameter is not critical, typical values being 5 μm at 25 GHz decreasing with frequency to about 1 μm at 500 GHz.

Figure 4:
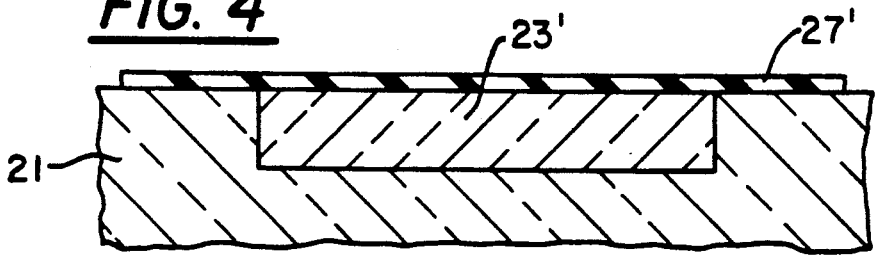
FIGS. 4 to 7 are cross-section drawing showing the intermediate stages of fabrication of this mixer.
Figure 5:
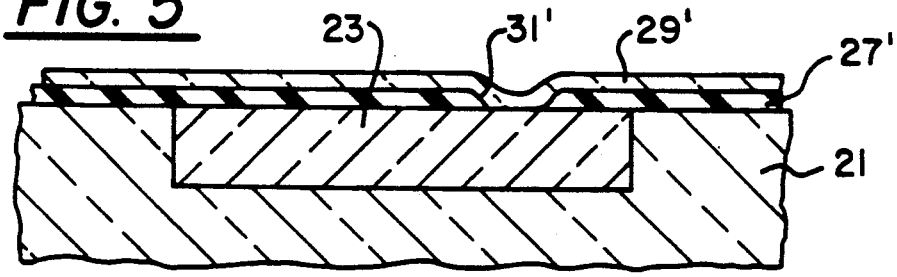

The monolithic antenna-diode sensor may be fabricated by conventional semiconductor processing, for example as shown in FIGS. 4 to 7. A substrate 21 of silicon is provided, an $n^+$ type diffusion region 23 is produced and a layer of oxide 27' thermally grown over the substrate surfaces (FIG. 4). A window region 31' is then defined in the oxide layer 27' by photolithography followed by an etch. After the exposed surfaces have been cleaned, a layer of n-type silicon 29' is then grown epitaxially so to produce a layer over the $n^+$-type region 23 exposed through the window 31' of the oxide layer 27' (FIG. 5).

Figure 6:
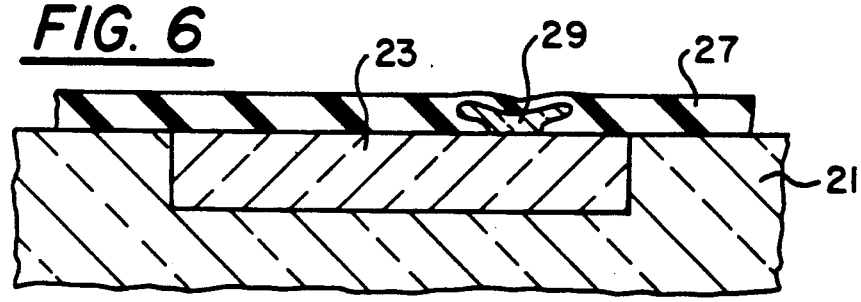
Figure 7:
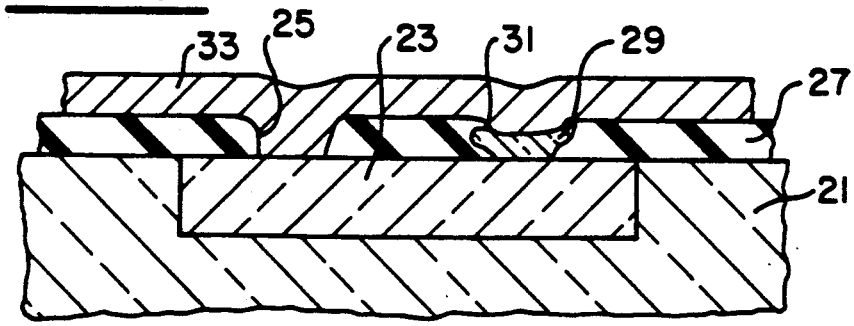

Photolithography and etching removes most of the layer 29', leaving only the region 29 in and just around the window 31'. Silicon oxide is deposited over the exposed surface of the substrate 21 covering the barrier region and forming a thicker oxide layer 23 over the rest of the surface (FIG. 6). Windows 25 and 31 are then photolithographically defined and etched through the oxide layer 27 and metal evaporated on to the surface of the substrate to form a layer 33, forming an ohmic contact through one window 25 and a barrier contact through the other window 31 (FIG. 7). The antenna limbs 3, 5 and transmission line arms 11, 13 are then photolithographically defined and left when excess metal has been etched away from the metal layer 33.

Alternatively, window 31 may be etched before window 25 and a metal, such as titanium, nickel or chromium, which makes a good Schottkey barrier contact to n-type silicon is evaporated over. This metal is photolithographically defined and etched, leaving it in and just around the window 31. Window 25 is the defined and etched, a top layer of metal is evaporated over and the antenna limbs 3, 5 and transmission line arms, 11, 13 are then defined and etched.

The monolithic integration of antenna and mixer can be extended to more complex configurations. Thus the mixer can be configured as a balanced mixer (FIGS. 8, 9 and 10) or, with somewhat more complexity, as a coherent mixer (FIGS. 11 to 15). It is a property of these mixers that the l.f. response, developed, is a null when only radiation of polarisation parallel to one pair of antenna limbs is received. This has the practical advantage of relative insensitivity to local oscillator amplitude fluctuations, i.e. to amplitude noise of the local oscillator. A signal is produced when this radiation is mixed with signal radiation of orthogonal polarisation.

Figure 8:
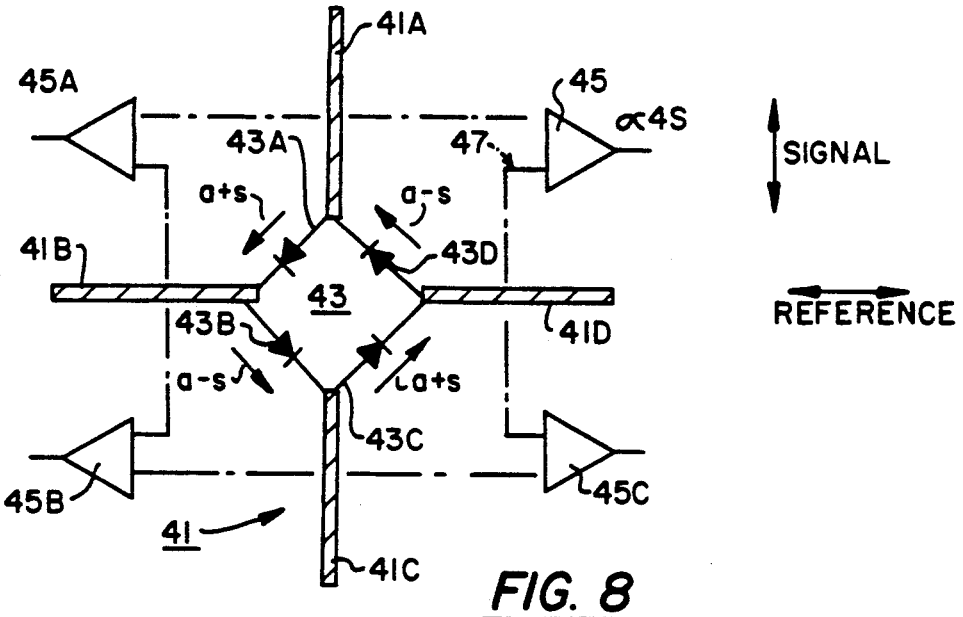
FIG. 8 is a schematic diagram of an alternative sensor, a sensor including a balanced mixer.

The sensor shown in FIG. 8 comprises a four-limb antenna 41 on a silicon substrate, the limbs 41A to 41D of the antenna 41 being interconnected by a balanced mixer 43 formed of a ring of Schottky diodes 43A to 43D, the diodes being arranged in head to tail order about this ring. Pairs of opposite limbs 41A and 41C, 41B and 41D, each form a dipole and these dipoles are arranged to be orthogonal to receive radiation, signal and reference, of orthogonal polarisation e.g. vertical and horizontal polarisation as shown. To ensure correct current phasing in the sensor, it is important that the diodes 43A to 43D are arranged symmetrically with respect to the antenna limbs 41A to 41D. For a phase error of ±1% of 2 π radians at 100 GHz, this implies a positional tolerance of about ±10 μm.

The current flow pattern developed in the sensor can be represented by equivalent short circuit currents of amplitude a±s through each diode, "a" being a current component due to rectification of the local oscillator alone and "s" being the current component arising from the mixing of the reference and signal. The ring arrangement provides a natural short circuit path for the rectified local oscillator current "a" (i.e. in the absence of signal radiation, the voltage across each diode is zero). The mixed current component "s", representing the response signal, however, may be extracted from any pair of adjacent limbs (e.g. 41A and 41D), and taken to a pre-amplifier circuit integrated in the substrate (e.g. circuit 45) via connections 47.

In principle greater sensitivity may be obtained by combining the low frequency signals from all four diodes. One way is to fabricate connections across the mixer ring, i.e. from limb 41A to limb 41C and from limb 41B to limb 41D. Alternatively, am amplifier could be connected across each diode and the signals combined after amplification. These amplifiers are numbered 45, 45A, 45B and 45C in FIG. 8. However in all cases the low frequency connections to the amplifier or amplifiers, or connections across the mixer ring, need to be made in such a way that the high frequency currents are not modified or dissipated to an unacceptable degree. The connections cannot be metallic since this would distort the antenna action. They may be made of resistive material such as doped semiconductor, but in this case the sheet resistivity must be high enough to give minimal absorption of high frequency signals. Calculations show that the sheet resistivity should exceed about 300 Ω per square and the total resistance of each connection must greatly exceed the antenna impedance on resonance, which is typically 25 Ω. High sheet resistivity is particularly important close to the antenna metal where the fringing electric fields are highest. For minimal dissipation of the high frequency power the resistance of each connection needs to exceed a figure of the order $10^3$ Ω and this series resistance will degrade the signal/noise ratio of the mixer and amplifier. For applications needing optimum signal/noise this would not be acceptable, but for applications tolerating reduced sensitivity, this approach may be used.

An alternative arrangement for the l.f. output port, eliminating the resistive connection to the low frequency amplifier, results from splitting one or more of the antenna limbs 41A to 41D. Each split limb comprises a pair of closely spaced metal conductors and functions as a low impedance transmission line, so that the h.f. voltage across each pair of conductors is low. In effect, the split limbs are shorted at h.f. but isolated at l.f. The h.f. impedance between the conductors may be further reduced by increasing the capacitance between them. One method is to form small regions of highly doped semiconductor extending under both metal conductors but dc isolated from the metal by the oxide layer. Alternatively a dielectric layer may be deposited over the metal and a further metal layer overlaid on the dielectric. One opposite pair of diodes is reversed relative to the configuration shown in FIG. 8 and the l.f. signal output can be extracted between the pair of conductors forming one of the limbs.

Figure 9:
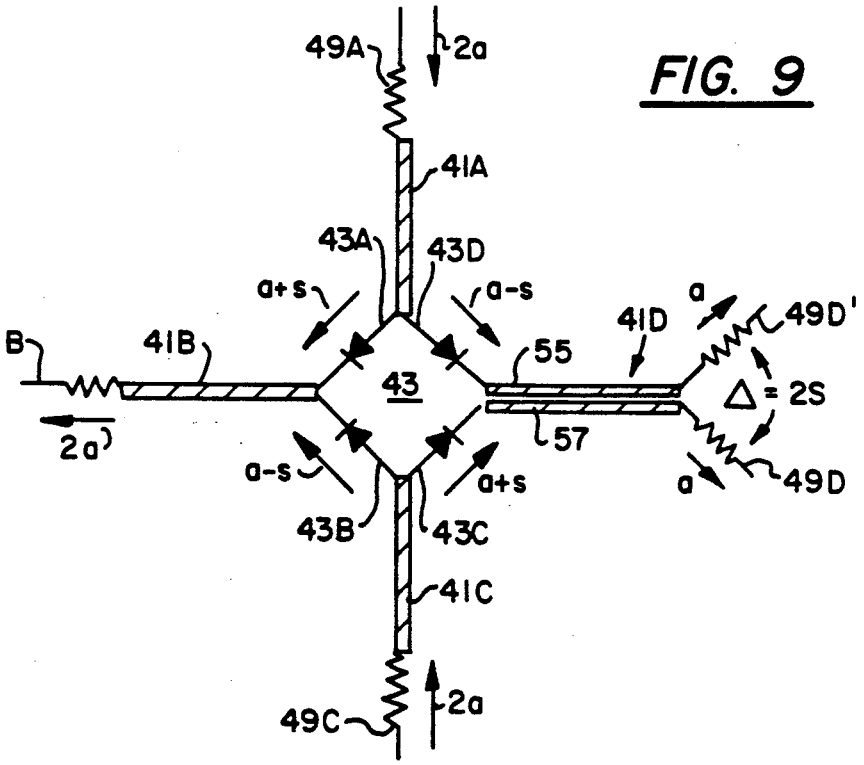
FIG. 9 is a schematic diagram of an alternative sensor, a modification of the sensor shown in FIG. 8 above.

In the example shown in FIG. 9 the limb 41D is split, with the two diodes 43B and 43D reversed, and the output is extracted across the two branches of this limb 41D, the two parallel conductors 55 and 57 shown in FIG. 9. A low frequency amplifier can be connected between these metal conductors 55 and 57 without the need for non-metallic resistive connections 47, and therefore without consequent sensitivity penalty. It is convenient to situate the low frequency amplifier beneath the metal forming the split limb 41D because the high frequency electric field is weak and the presence of the amplifier components, such as transistors, does not significantly modify the antenna action.

The amplifier may be isolated from the metal at low frequency by an oxide layer where necessary. Power supplies and output connections for the amplifier need to be through resistive links, but this involves very little degradation of the overall signal/noise ratio and modest power dissipation. The dc currents through the diodes 43A to 43D cannot flow around the diode ring because it no longer has a head to tail configuration. Instead the currents need to be taken through external circuits, but these can be made resistive without degrading the receiver sensitivity. Resistive connections 49A to 49D and 49D' for diode biassing, are provided at the end of each of the limbs 41A to 41D as shown in FIG. 9.

Figure 10:
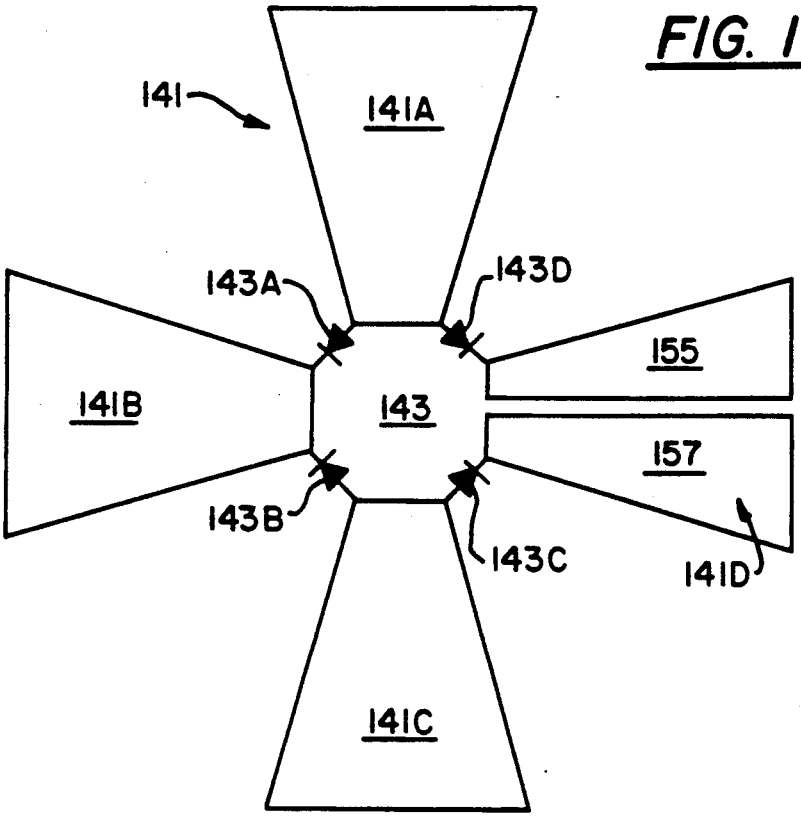
FIG. 10 is a plan drawing of an alternative sensor a modification of the sensor shown in FIG. 9 above.

The antenna limbs need not have rectangular configurations. An alternative geometry is obtained by widening the metal away from the antenna centre. Thus as shown in FIG. 10 the antenna comprises four limbs 141A to 141D each of wedge shape. The side limb 141D is split into half portions 155 and 157 as in FIG. 9 preceding, these limbs 141A to 141D are interconnected by a ring of diodes 143A to 143D. These are arranged as the diodes in FIG. 9 and the whole behave as a balanced mixer. Calculations show that the resonant frequency of the antenna is slightly reduced and the admittance slightly increased by this change of shape. The widened antenna allows a greater area for low frequency integrated circuit components underneath the metal.

An alternative diode and antenna arrangement is shown FIGS. 11 to 14. The antenna 241 shown has two side limbs 241B and 241D and extending traverse to these in the orthogonal direction, an upper limb 241A and a lower limb 241C. The side limbs 241B and 241D together form a dipole of chosen length λ/2 and each is split along its length. It is necessary for each split limb to act as a single conducting element at high frequency and it can be advantageous to increase the capacitance between the parts of the split limbs such as by the techniques already described for the split limbs of the balanced mixer of FIG. 9. The upper and lower limbs 241A and 241C together with a partitioned strip of metal 261 extending in between these limbs 241A and 241C, form a modified dipole, also of chosen length λ/2.

Figure 12:
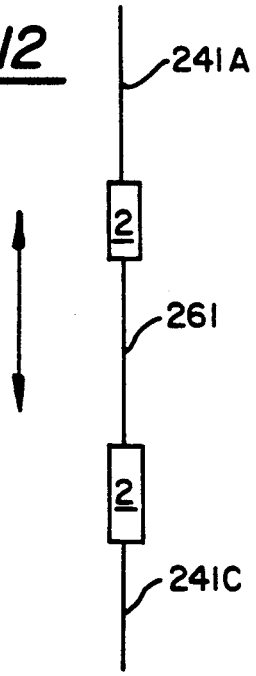
FIGS. 11, 12 and 13 are circuit diagrams.
Figure 13:
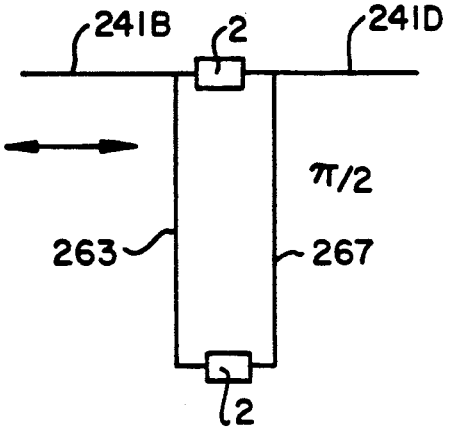

The upper and lower limbs are each chosen of equal length approximately λ/8, and the partitioned strip 261 is of length λ/4, i.e. of length one-quarter wavelength corresponding to the resonant frequency of the dipole formed by the side limbs 241B and 241D of the antenna 241. The split limbs 241B and 241D have upper and lower branches 251 and 253, 255 and 257 respectively. The partitioned strip of metal 261 is composed of three parallel conductors 263, 265 and 267. The outermost narrow conductors 263 and 267 are co-extensive with an orthogonal to the lower branches 253 and 257 of the side limbs 241B and 241D. The three conductors 263, 265 and 267 complete the dipole dormed by the limbs 241A, 241C of the antenna 241, and also function as a transmission line λ/4 long connected across the side limbs 241B and 241D. For radiation of vertical polarisation as shown, no transverse electro-magnetic (TEM) mode of the transmission line 261 is excited and the two pairs of diodes 243A, 243D and 243B, 243C act as loads Z symmetrically placed on the antenna 241 (FIG. 12). The radiation couples to an antenna mode in which the load currents are equal. For radiation of horizontal polarisation as shown, the transmission line introduces a phase shift of $\pi/2$ between the signals at the lower and upper loads Z. The third and middle conductor 265 extends from the upper branch 251 of one of the side limbs 241B to the lower end of the partition strip 261 where it is connected to the outermost conductor 267. This middle conductor 265 provides a low frequency connection to the lower branch 257 of the other side limb 241B. This allows a redistribution of the low frequency current flowing in the side limbs and serves to separate in-phase $S_1$ and quadrature $S_2$ response signals. Thus an in-phase response signal $S_1$ can be relayed by the output port formed by the split side limb 241D, and the quadrature response signal $S_2$ can be relayed by the output port formed by the other split limb 241B.

Because the centre conductor 265 is connected to conductor 267 at one end (the lower end as drawn in FIG. 14) and at its other end is connected via the antenna arm 241B, which presents a low h.f. impedance, to conductor 263, inclusion of the centre conductor modifies the h.f. properties of the transmission line 261. The most important effect is to increase the matching impedance for a transmission line with an electrical length of a quarter wavelength. In order to provide a good match to the mixer diodes, it is convenient to choose a transmission line impedance that is not too high and this can be achieved by making the width of the centre conductor 265 small compared with the widths of the outer conductors 263 and 267 and also compared with the spacing between the three conductors 263, 265 and 267.

Figure 14:
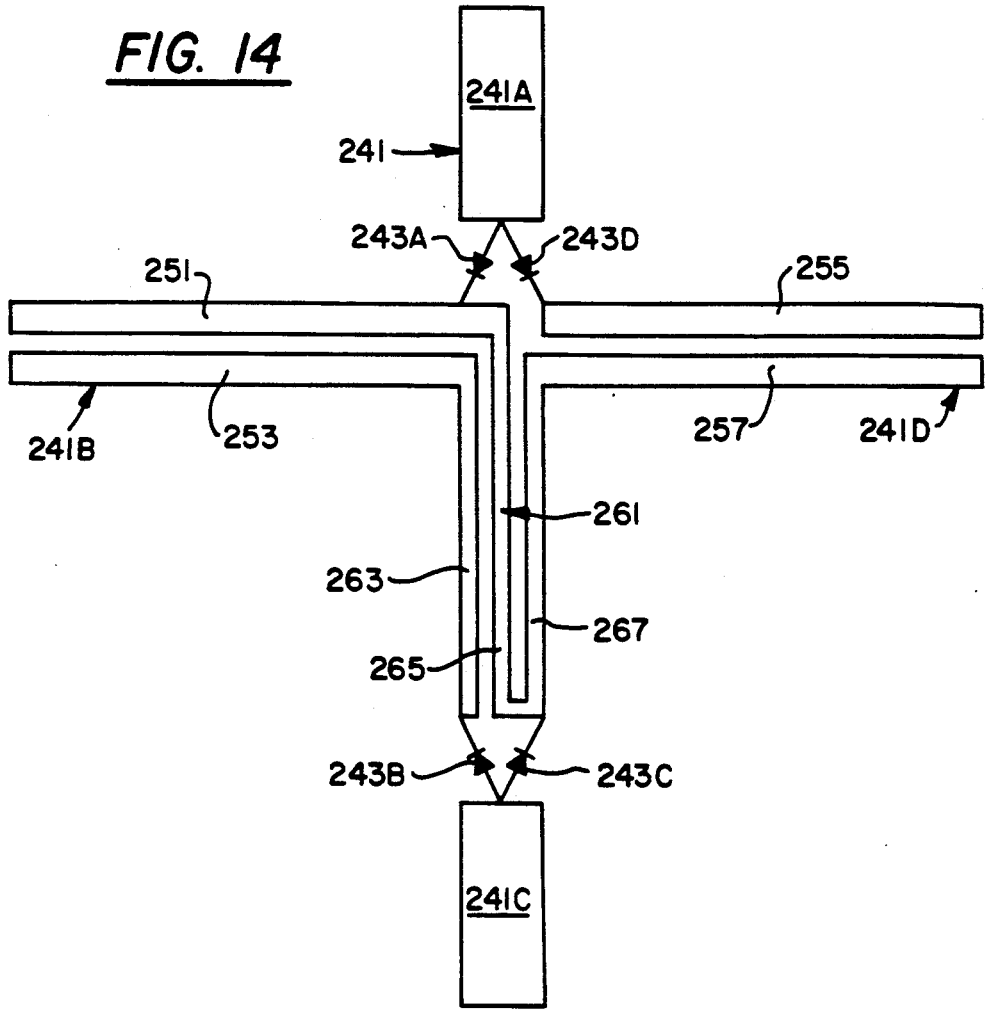
FIG. 14 is an illustrative plan drawing, of an alternative sensor, a sensor including a coherent mixer.
Figure 11:
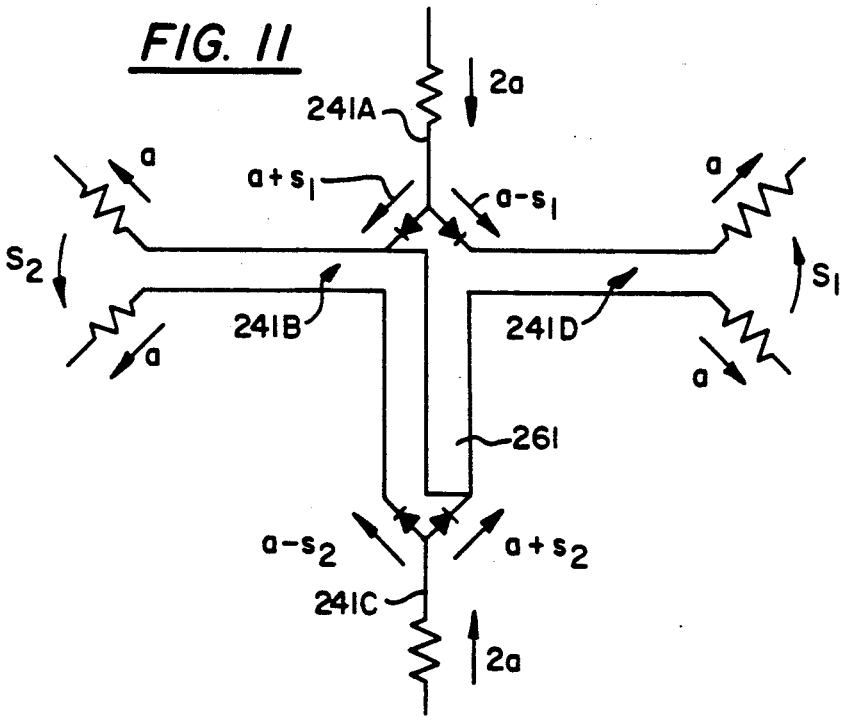

In the coherent mixer configuration shown in FIG. 14 the transverse dipole 214B–241D is located a distance $\lambda/8$ from the antenna centre. This results in a significant difference in the dipole impedances produced at the break bridged by the upper pair of diodes 243A and 243D and at the break bridged by the lower pair of diodes 243B and 243C. Greater sensor efficiency may be achieved by a straightforward modification. The impedance difference may be reduced by locating the transverse dipole 241B–241D relatively closer to the antenna centre and by altering the relative dimensions of the dipole limbs 241A, 241C and of the three-line section 261. Decrease in the transverse dipole to antenna centre offset results in reduced field distortion in the vicinity of the upper pair of diodes 243A, 243D, and in consequence the impedance at the break is more nearly equal to the impedance at the lower break. Care must be taken to ensure that the desired signal phase relationships are maintained. One way of achieving correct phase relationships, is to use the sensor with a local oscillator running at an appropriate matching frequency: to illustrate this, consider the use of a local oscillator running at one half the resonant signal frequency $f_s$. An efficient coherent mixer for this application may be dimensioned as follows:

Length of transverse dipole: $\lambda_s/2$ (This dipole 241B–241D is resonant at the signal frequency $f_s$, and is aligned parallel to the plane of signal polarisation);

Length of logitudinal dipole: $\lambda_s$ (This dipole 241A–241C is resonant at the local oscillator frequency $f_s/2$ and is aligned parallel to the plane of the local oscillator radiation polarisation, a plane orthogonal to the plane of signal polarisation);

Transverse dipole offset: $\lambda_s/8$;

Length of three-line section: $\lambda_s/4$.

Since the three-line section 261 is of length one-quarter of the signal resonant wavelength, the correct phase relationships are maintained.

It is possible to vary the oscillator frequency, matching length of the longitudinal dipole, and transverse dipole offset, whilst maintaining the length of the three-line section at $\lambda_s/4$, to give other efficient configurations.

Another way of achieving correct phase relationships is to load the three-line section 261 to slow the signal propagation along the section. This could be attained using discrete capacitive loading. One method for providing the capacitative loading is to overlay the metal conductors 263, 265 and 267 with strips of metal transverse to the conductors 263, 265 and 267 and separated from them by a layer of dielectric.

Figure 15:
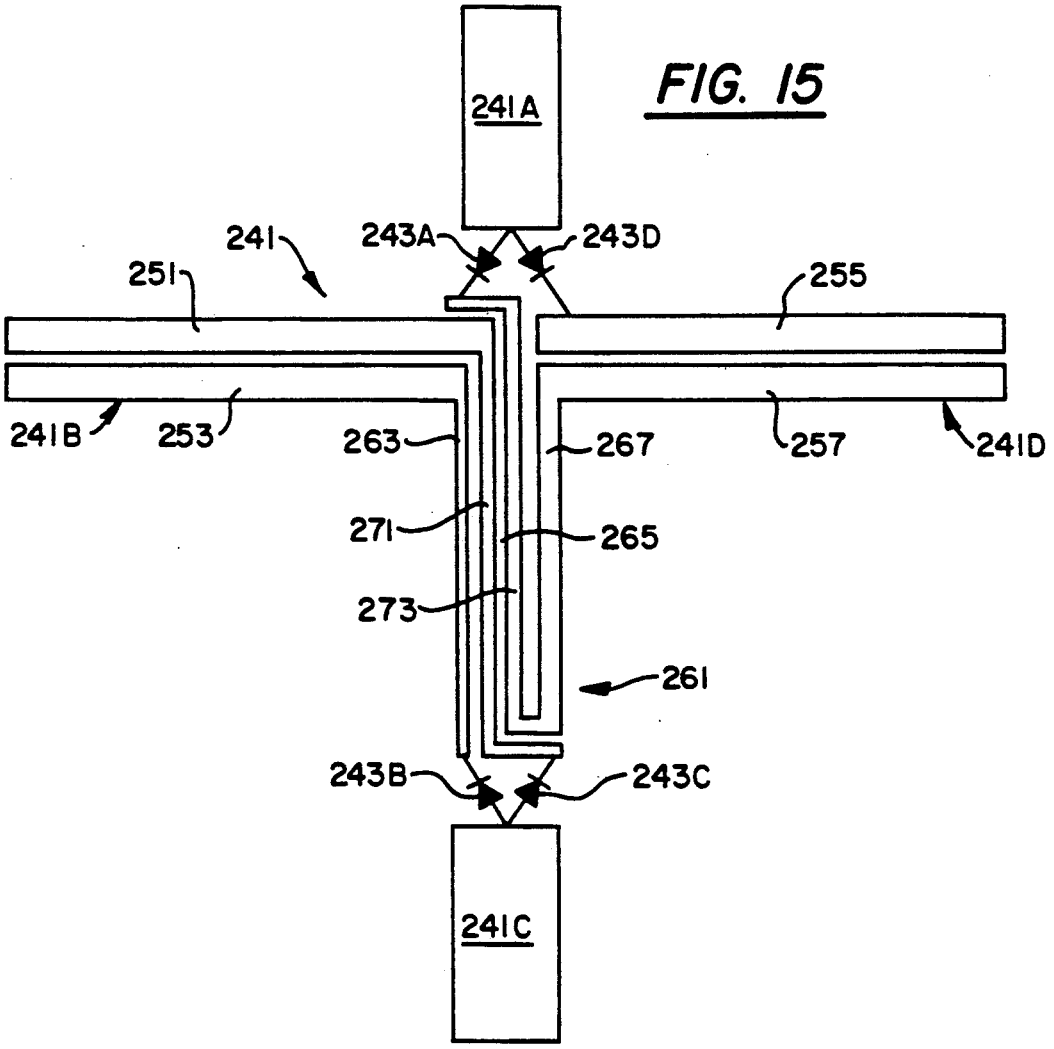
FIG. 15 is an illustrative plan drawing of an alternative sensor, a modification of the sensor shown in FIG. 14 above.

A property of the diode antenna combination illustrated FIGS. 11 to 14 is that the low frequency ports have a common connection viz conductor 265. Port isolation can be achieved by simple modification, to allow simplification of the design of the associated low frequency amplifiers. In the modification that is shown in FIG. 15 the connecting conductor 265 is split down its entire length into two separate conductor portions 271 and 273. In doing this it is also ensured that enough capacitance is provided between the two conductor portions 271 and 273, or the capacitance is supplemented in the manner already described if necessary.

It will be noted that the polarity of each diode is shown by the conventional symbol. However the polarity of all the diodes in any one of the above examples may be reversed without altering the mixer function and often one or other choice of direction will be preferable for compatibility with the low frequency circuitry.

Figure 16:
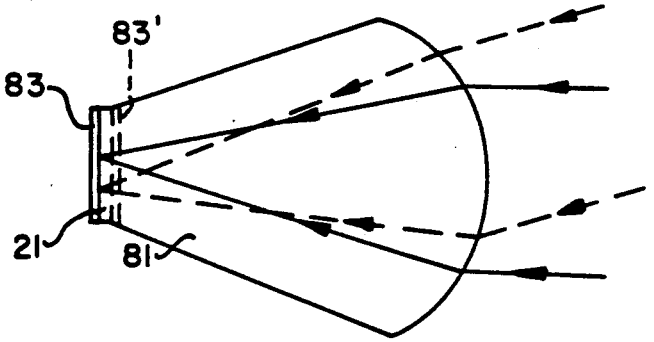
FIGS. 16 and 17 show in cross-section and plan a lens-mounted sensor array.
Figure 17:
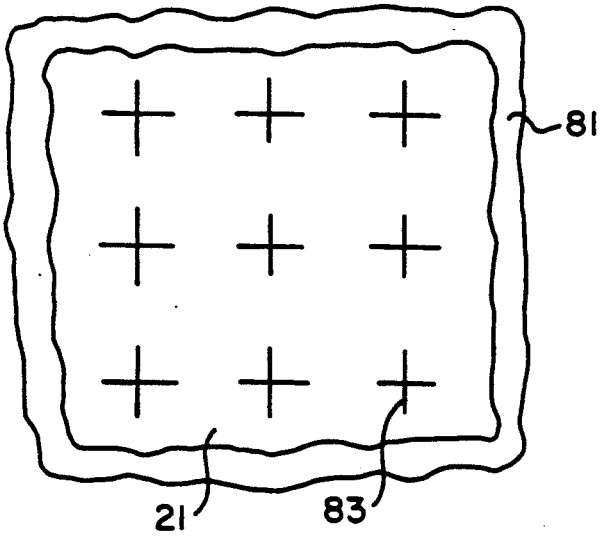

One or more of the sensors described above may be combined with a dielectric lens. This is shown in FIGS. 16, 17 where the silicon supporting substrate 21 is bonded to the plane back surface of a dielectric lens 81 of alumina ceramic ($\epsilon \simeq 10$). The sensors 83 are arranged in an array on the back surface of the substrate 21, and are located in the focal plane of the lens 81. Each sensor, lying in a different region of the focal plane will thus correspond to radiation incident from a different angle to the axis of the lens. Reference radiation of appropriate polarisation may be supplied by a local oscillator. This radiation can be introduced from the back of the sensor—i.e. from the air medium, where antenna coupling is weak. Alternatively the local oscillator signal may be introduced by propagation through the lens—i.e. from the dielectric/semiconductor medium where antenna coupling is strong. In this case it is necessary to locate the local oscillator near to the lens 81 so that the reference radiation can be coupled to all the sensors 83 of the array. It is an advantage that the sensors 83 are located on the back surface of the substrate lens combination, for here they are readily accessible and conventional bonds can be made to the associated low frequency circuits.

Another method for illuminating the receiver antennae with local oscillator power is to radiate power into the dielectric lens using a transmission antenna at some point on its surface so that radiation internally reflected at the surface of the lens falls on to the semiconductor chip supporting the antennae.

Alternatively, the internal reflection could take place on a mirror surface constructed inside the lens, e.g. by a grid of metal wires aligned parallel to the polarisation of the radiation the mirror is required to reflect. The metal wire grid will transmit the orthogonal polarisation, which is convenient for separating the paths taken by local oscillator and signal radiation.

A useful sensor spacing across the array is that which corresponds to the resolution of the lens given by the Rayleight criterion according to which the resolved spot separation is roughly $1.2\ F\ \lambda/n$ where F is the lens F-number i.e. ratio of focal length to diameter of the lens chosen to be close to 0.7 in the present case, $\lambda$ is the free space wavelength and n the refractive index of the dielectric. At a frequency of 100 GHz, the resolved spot separation is about 800 $\mu$m for a dielectric having dielectric constant $\epsilon \simeq 10$ a dielectric approximately matched to silicon ($\epsilon \simeq 11.7$). Thus the sensors can be arranged 800 $\mu$m from centre to match this resolution, each sensor occupying a cell approximately 600 $\mu$m square. This arrangement of lens and sensor array is advantageous, for it allows collection of signal radiation in the different resolved beams of the lens at the same time.

The sensor array also permits comparison of signals received simultaneously from different directions in order to construct a picture of the reflecting object. The bonded array may then be situated at a distance from the focal plane so that incident radiation from a chosen direction couples to several or all of these sensors. It is then possible to construct the far field pattern by combining sensor signals during subsequent signal processing. In this way, higher angular resolution than that given by the Rayleigh criterion can be achieved.

The dielectric constant of the lens material is a major factor determining the resonant length of an antenna for a given frequency. As long as the semiconductor body is very much thinner than the wavelength in the semiconductor, the antenna resonant frequency and impedance will be chiefly determined by the dielectric constant of the lens rather than that of the semiconductor. An alternative to the use of a lens material with dielectric constant close to that of the semiconductor is to use a lens material with a higher or lower dielectric constant. With a higher dielectric constant the antenna length and resolved spot size are reduced by a factor approximately equal to $$\sqrt{\epsilon_1/\epsilon_s}$$

where $\epsilon_1$ is the lens dielectric constant and $\epsilon_s$ is the semiconductor dielectric constant. This can be convenient for reducing the size of a receiver or of a receiver array for lower frequencies where the wavelength in the semiconductor would lead to an inconveniently large circuit size. This choice of lens dielectric constant is therefore most suited to frequencies below about 60 GHz. One suitable material for the lens is barium nonatitanate ($Ba_2Ti_9O_{20}$) ceramic which has a dielectric constant close to 39 and which reduces the resonant length of antenna and the resolved spot dimension by a factor of about 2 compared with a lens made from alumina ceramic.

Use of a lower dielectric constant material such as silica or PTFE increases the antenna resonant length and resolved spot size and this may be convenient when the required circuit dimensions would otherwise be inconveniently low such as for frequencies over 250 GHz. There is now a potential problem in that radiation could be trapped in the semiconductor body because its dielectric constant is higher than that of the media either side. This could cause undesirable coupling between antennae. The problem may be reduced by thinning the semiconductor body, or by increasing its conductivity to increase the trapped wave losses or by doing both.

It is not necessary for the lens to be made from a homogeneous material. The antenna and receiver sizes are determined by the dielectric constant of the lens material adjacent to the semiconductor body. Outer layers of the lens may be made from other materials without significant effects on the antenna resonance, but such outer layers will alter the focal length and the far field lens pattern in the same way as multiple layer lenses are used at visible light wavelengths (e.g. in cameras). A multiple layer lens may therefore be used to modify the field of view of a sensor array.

An alternative approach to the above, one particularly suited to lower frequency (longer wavelength) applications, is to mount the antenna or, array of antennae, 83' between the semi-conductor substrate 21 and a support body 81 of significantly higher dielectric constant material. In this case the antenna radiation pattern and resonance are strongly dependent upon the dielectric properties of the support body 81 (see FIG. 16). Each sensor is in this case predominantly sensitive to radiation incident from the support body side of the antenna. The semiconductor substrate 21 here serves only to integrate the mixer diodes and other circuit components, whilst the support body 81 serves as the propagating medium and may be shaped as a lens or part of a compound lens.

OVERLOAD PROTECTION

Figure 18:
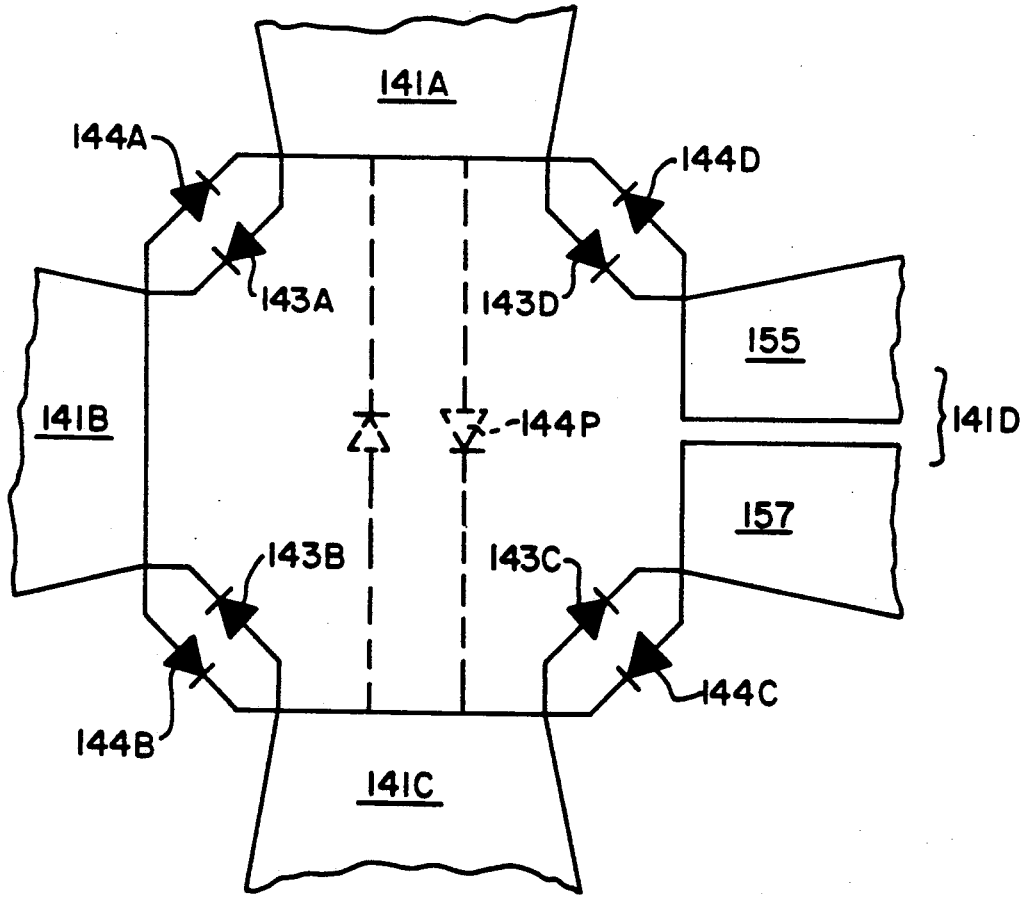
FIGS. 18 and 19 show in plan a balanced mixer including limiter diodes.

The diode ring sensors shown in FIGS. 8, 9, 10, 14 and 15 may be modified readily to protect the sensor circuitry against damage by high power radiation incident on the sensor optics. One approach is to shunt each mixer diode with a limiter element, e.g. a Schottky or PIN diode. This approach is illustrated in FIG. 18. Each of the mixer diodes 143A to 143D is shunted by a Schottky diode 144A to 144D. Each limiter diode—e.g. 144A, is arranged anti-parallel—i.e. head-to-tail, and tail-to-head, with the corresponding mixer diode—e.g. 143A. Under normal conditions, when signal levels are low, each limiter diode is reverse biassed, being in a low current, high impedance state. Under overload conditions, however, each limiter conducts strongly and has a low impedance. This limits the voltages developed across the mixer diodes. When the radiation level is reduced, the limiter diodes revert to their normal state. In this case, overload protection is provided irrespective of the polarisation of the incident radiation.

Another approach is to connect one or more limiter pairs—e.g. a pair of anti-parallel Schottky diodes, or a Schottky diode and an anti-parallel PIN diode-between the opposite limbs of one of the crossed dipoles of the antenna. In this case, in FIG. 18, the limiter diodes 144A to 144D are replaced by a limiter pair 144P connected between the dipole limbs 141A and 141C of the antenna 141. However, in this arrangement, overload protection is provided for one polarisation of radiation only, the polarisation parallel to the bridged dipole 141A–141C. Under normal conditions, i.e. in low signal operation, the voltage appearing across the limiter pair is very low, irrespective of the magnitude of the local oscillator radiation, radiation polarised parallel to the orthogonal dipole 141B–141D, so a high impedance state for the diode pair is achieved readily.

Figure 19:
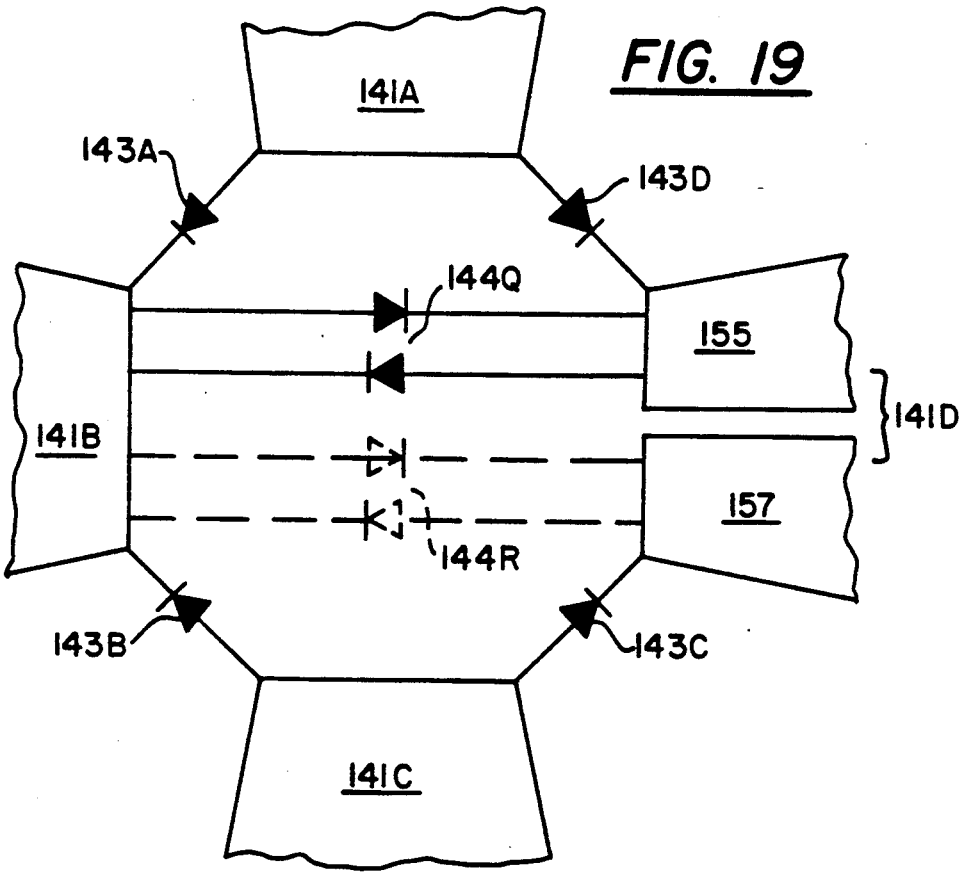

In FIG. 19, two limiter pairs 144Q, 144R are used to provide overload protection against signal radiation polarised parallel to the other dipole, dipole 141B–141C. Each limiter pair 144Q, 144R is connected between one limb 141B and one of the split portions 155, 157 of the other limb 141D. Provided the capacitance between the split limb portions 155 and 157 can be made large enough so that high frequency voltages between the two limb portions are always low, one of the limiter pairs 144Q or 144R may be omitted.

The optical system can be designed to prevent incident signal radiation polarised parallel to that from the local oscillator from reaching the antenna. One way of doing this is to incorporate a polarisation selective filter comprising an array of conductive stripes. This filter has the property of reflecting radiation with its electric field (E-vector) parallel to the stripes whilst passing radiation of orthogonal polarisation.

The bias circuits may also be modified to provide a degree of overload protection, and this may be used as an alternative to, or in combination with the inclusion of limiters. Both the conversion loss and the high frequency overload power of the diodes are dependant on bias level. The bias control circuits may be designed to increase forward bias level wherever high incident power is sensed, to protect the sensor circuits and diodes.

The sensor or sensor arrays described hereinbefore may be combined with a local oscillator to provide a radiometer for sensing natural emissions, or an anti-radiation detector for detecting man-made emissions. Alternatively, they may be combined with a local oscillator and a transmitter (local, or remote), to provide a radar or communications system.

Figure 20:
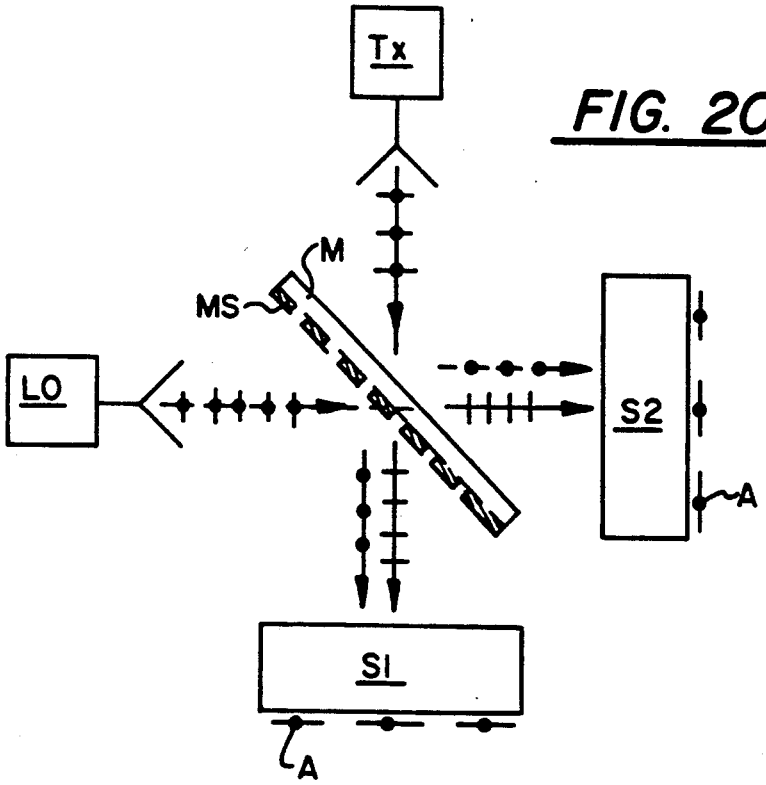
FIG. 20 is an elevation view of a receiver system including two sensor arrays.

FIG. 20 illustrates a system incorporating two biassed sensor arrays S1, S2 used for resolving the different polarisation components of a signal emission, for example the emission from a remote transmitter Tx. The system optics includes a polarisation sensitive mirror filter M, inclined to the antenna array planes of the two sensor arrays S1, S2. This mirror M comprises a grid of parallel metal stripes MS, and the mirror M is arranged with these stripes MS parallel or orthogonal to the antenna dipiles A. This mirror has the property of reflecting radiation polarised parallel to the stripes MS whilst transmitting radiation of orthogonal polarisation.

The system includes a local oscillator L.O. arranged relative to the mirror M to illuminate the two sensor arrays S1, S2 with reference radiation of a resonant frequency. The mirror M serves to separate the orthogonal components of the reference radiation, and the polarisation of the reference radiation which may be circular, elliptic or linear, is arranged so that the reflected and transmitted beams are of equal amplitude. The mirror M also serves to separate the orthogonal polarisation components of the signal radiation. The transmitted beam and the reflected beam incident on each sensor array, are of orthogonal polarisation, as shown. This system which may be assembled compactly, thus enables simultaneous resolution of the signal radiation.

Having described the invention and the manner by which it may be performed, I claim:

1. An electromagnetic radiation sensor comprising:
(1) a substrate in the form of a sheet having front and rear surfaces and comprising at least partly a semiconductor material;
(2) a dipole antenna having two limbs mounted on the substrate front surface;
(3) mixing means connected between the dipole limbs and comprising at least one mixer diode integrated onto the substrate semiconductor material and arranged to mix high frequency antenna signals to produce low frequency output signals;
(4) a conductor configuration arranged on the substrate front surface and connected to the mixing means to relay low frequency signals therefrom to a sensor output; and
(5) a dielectric lens having a flat surface arranged closely adjacent to the substrate rear surface to couple radiation to the antenna via the substrate, the dielectric constants of the lens and substrate, the lens dimensions and the lens-antenna spacing being in combination such as to cause the antenna to couple predominantly to radiation passing through the lens and the substrate thickness.

2. An electromagnetic radiation sensor comprising:
(1) a substrate in the form of a sheet having front and rear surfaces and comprising at least partially a semiconductor material;
(2) a dipole antenna having two limbs mounted on the substrate front surface;
(3) mixing means connected between the antenna limbs and comprising at least one mixer diode integrated on the substrate semiconductor material and arranged to mix high frequency antenna signals to produce low frequency output signals;
(4) a conductor configuration arranged on the substrate front surface and connected to the mixing means to relay low frequency signals therefrom to a sensor output;
(5) a dielectric lens having a flat surface arranged closely adjacent to the dipole such that the dipole is located between the lens and substrate, the relative dimensions, material compositions and dielectric constants of the lens and substrate being in combination such as to cause the dipole to couple predominantly to radiation reaching it via the lens.

3. An electromagnetic radiation sensor comprising:
(1) a substrate in the form of a sheet having front and rear surfaces and comprising at least partly a semiconductor material,
(2) an array of dipole antennas each having two limbs mounted on the substrate front surface;
(3) a respective mixing means for each antenna connected between its limbs and comprising at least one mixer diode integrated onto the substrate semiconductor material and arranged to mix high frequency antenna signals to produce low frequency output signals;
(4) a respective conductor configuration for each antenna arranged on the substrate front surface and connected to the respective mixing means to relay low frequency signals therefrom to a sensor output; and
(5) a dielectric lens having a flat surface arranged closely adjacent to the substrate rear surface to couple radiation to the antennas via the substrate, the dielectric constants of the lens and substrate, the lens dimensions and the lens-antenna spacing being in combination such as to cause each antenna to couple predominantly to radiation passing through the lens and the substrate thickness.

4. An electromagnetic radiation sensor comprising:
(1) a substrate in the form of a sheet having front and rear surfaces and comprising at least partially a semiconductor material,
(2) an array of dipole antennas each having two limbs mounted on the substrate front surface;
(3) a respective mixing means for each antenna connected between its limbs and comprising at least one mixer diode integrated on the substrate semiconductor material and arranged to mix high frequency antenna signals to produce low frequency output signals;
(4) a respective conductor configuration for each antenna arranged on the substrate front surface and connected to the respective mixing means to relay low frequency signals therefrom to a sensor output; and
(5) a dielectric lens having a flat surface arranged closely adjacent the antenna array such that the array is located between the lens and substrate, the relative dimensions, material compositions and dielectric constants of the lens and substrate being in combination such as to cause each antenna to couple predominantly to radiation reaching it via the lens.

5. An electromagnetic radiation sensor comprising:

(1) a dipolar antenna comprising two crossed and mutually orthogonal dipoles, each with two limbs;

(2) a local oscillator, arranged to couple a reference signal to one of the dipoles, the other dipole being arranged to receive radiative signals;

(3) mixing means, connected between limbs of the antenna, including four mixer diodes, each connected between a respective pair of limbs of different dipoles and arranged to mix radiative and reference signals received by the two dipoles to produce low frequency output signals; and (4) relaying means for transferring low frequency output signals from the mixing means to a sensor output.

6. A sensor according to claim 5 wherein:

(1) the relaying means is an antenna limb which is divided along its length into two branches connected to respective ones of said mixer diodes; and (2) the limbs of one dipole are connected to respective pairs of the mixer diodes polarized towards the mixer diodes and the limbs of the other dipole are connected to respective pairs of the mixer diodes polarized away from the mixer diodes;

and further comprising:

(3) a low frequency amplifier connected to the divided dipole limb and located in a region of a weak electric field at high frequency.

7. A sensor according to claim 6 wherein the low frequency amplifier is located beneath the divided dipole limb.

8. A sensor according to claim 7 wherein the mixer diodes and low frequency amplifier are integrated in substrate semiconductor material.

9. A sensor according to claim 5 wherein the antenna has wedge-shaped limbs covering electronic components.

10. A sensor according to claim 5 wherein one of the dipoles has both limbs divided along their lengths and the other dipole has outer limb portions connected together via a first pair of the mixer diodes, a transmission line and a second pair of the mixer diodes, the transmission line being connected to the divided limb dipole and configured to provide for in-phase and quadrature low frequency signals to appear on respective divided limbs.

11. A sensor as claimed in claim 10 wherein the transmission line comprises four conductors and is arranged to isolate one divided limb from the other at low frequency.

12. A sensor as claimed in claim 10 wherein the transmission line is capacitatively loaded to provide a resonant electrical length half that of the divided limb dipole.

* * * * *